US009564722B2

(12) United States Patent
Ning et al.

(10) Patent No.: US 9,564,722 B2
(45) Date of Patent: Feb. 7, 2017

(54) WATERPROOF AUDIO JACK CONNECTOR

(71) Applicant: FOXCONN INTERCONNECT TECHNOLOGY LIMITED, Grand Cayman (KY)

(72) Inventors: Qiang Ning, Shenzhen (CN); Cen Lu, Shenzhen (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/828,419

(22) Filed: Aug. 17, 2015

(65) Prior Publication Data

US 2016/0049755 A1 Feb. 18, 2016

(30) Foreign Application Priority Data

Aug. 18, 2014 (CN) ..... 2014 2 0465172 U

(51) Int. Cl.

| | |
|---|---|
| ***H01R 24/58*** | (2011.01) |
| *H01R 13/52* | (2006.01) |
| *H01R 107/00* | (2006.01) |
| *H01R 12/72* | (2011.01) |

(52) U.S. Cl.

CPC ..... *H01R 24/58* (2013.01); *H01R 12/722* (2013.01); *H01R 13/5202* (2013.01); *H01R 2107/00* (2013.01)

(58) Field of Classification Search

USPC ..... 439/587, 668, 669, 271, 274, 76.2; 174/74 R

See application file for complete search history.

(56) References Cited

U.S. PATENT DOCUMENTS

| | | | | |
|---|---|---|---|---|
| 5,145,410 | A * | 9/1992 | Maejima | H01R 13/5208 439/274 |
| 6,093,058 | A * | 7/2000 | Wu | H01R 24/58 439/607.35 |
| 7,388,152 | B2 * | 6/2008 | Cairns | H01B 7/28 174/74 R |
| 7,736,158 | B2 * | 6/2010 | Yamaguchi | H05K 7/026 439/271 |
| 8,100,726 | B2 * | 1/2012 | Harlan | H01R 13/2414 29/883 |
| 8,525,047 | B2 * | 9/2013 | Guntermann | H02G 3/22 174/650 |

(Continued)

*Primary Examiner* — Alexander Gilman

(74) *Attorney, Agent, or Firm* — Wei Te Chung; Ming Chieh Chang

(57) ABSTRACT

An audio jack connector (100) includes an insulative housing (1) having a number of passageways (111) and a number of slits (112) beside the passageways, and a number of contacts (2) retained in the passageways. Each contact includes a retaining portion (22) retained in the passageway, a contacting portion (21) extending inwardly from the retaining portion, and a horizontal portion (23) bent outwardly from the retaining portion and being located in a bottom face (11) of the insulative housing. The audio jack connector includes a glue plate (3) assembled to the bottom face of the insulative housing. The audio jack connector includes a glue frame (4) having a base portion (41) seamlessly sandwiched between the glue plate and the insulative housing, and a number of protrusions (42) seamlessly sandwiched between the horizontal portions of contacts and the insulative housing. The protrusions are received in the slits.

20 Claims, 8 Drawing Sheets

(56) References Cited

U.S. PATENT DOCUMENTS

| | | | | |
|---|---|---|---|---|
| 8,616,922 | B2 * | 12/2013 | Liu | H01R 12/57 439/669 |
| 8,678,863 | B2 * | 3/2014 | Nagata | H01R 13/5213 439/606 |
| 8,845,340 | B2 * | 9/2014 | Nakanishi | H01R 43/18 439/76.1 |
| 9,128,410 | B2 * | 9/2015 | Suzuki | H01R 13/5221 |
| 9,197,004 | B2 * | 11/2015 | Kuo | H01R 13/521 |
| 9,225,105 | B2 * | 12/2015 | Cheong | H01R 13/5213 |
| 2003/0181084 | A1 * | 9/2003 | Valasek, Jr. | H01R 13/62933 439/157 |
| 2011/0195611 | A1 * | 8/2011 | Little | H01R 13/52 439/668 |
| 2013/0183867 | A1 * | 7/2013 | Wu | H01R 24/58 439/668 |
| 2014/0038458 | A1 * | 2/2014 | Bausch | H01R 12/714 439/587 |
| 2014/0092532 | A1 * | 4/2014 | Kole | H04M 1/0249 361/679.01 |
| 2016/0049755 | A1 * | 2/2016 | Ning | H01R 24/58 439/587 |

* cited by examiner

WATERPROOF AUDIO JACK CONNECTOR

BACKGROUND OF THE INVENTION

1. Field of the Invention

The present invention relates generally to an audio jack connector, and more particularly to a waterproof audio jack connector.

2. Description of Related Arts

U.S. Patent Application Pub. No. 2013/0183867, published on Jul. 18, 2013, discloses an audio jack connector comprising an insulating housing and a number of contacts assembled in the insulating housing. The insulating housing defines a mating face with an insertion hole through which an audio plug is inserted into a receiving channel of the insulating housing, a rear surface opposite to the mating surface, a mounting surface facing a printed circuit board, and a top surface opposite to the mounting surface. The audio jack connector includes an insulative plate attached to the rear surface of the insulating housing and a solidified glue portion formed between the insulative plate and the insulating housing. The insulative plate defines a plurality of holes through which the contacts extend out of the insulating housing. The rear surface of the insulating housing is sealed by the insulative plate and the solidified glue portion. The glue is filled along a rear-to-front direction along which the contacts extend and is lightly filled in the interspace between adjacent two contacts for enwrapping the contacts.

A waterproof audio jack connector of a different structure is desired.

SUMMARY OF THE INVENTION

Accordingly, an object of the present invention is to provide an improved waterproof audio jack connector.

To achieve the above object, an audio jack connector includes an insulative housing having a number of passageways and a number of slits beside the passageways, and a number of contacts retained in the passageways. Each contact includes a retaining portion retained in the passageway, a contacting portion extending inwardly from the retaining portion, and a horizontal portion bent outwardly from the retaining portion and being located in a bottom face of the insulative housing. The audio jack connector includes a glue plate assembled to the bottom face of the insulative housing. The audio jack connector includes a glue frame having a base portion seamlessly sandwiched between the glue plate and the insulative housing, and a number of protrusions seamlessly sandwiched between the horizontal portions of contacts and the insulative housing. The protrusions are received in the slits.

Other objects, advantages and novel features of the invention will become more apparent from the following detailed description when taken in conjunction with the accompanying drawings.

DETAILED DESCRIPTION OF THE PREFERRED EMBODIMENT

Figure 1:
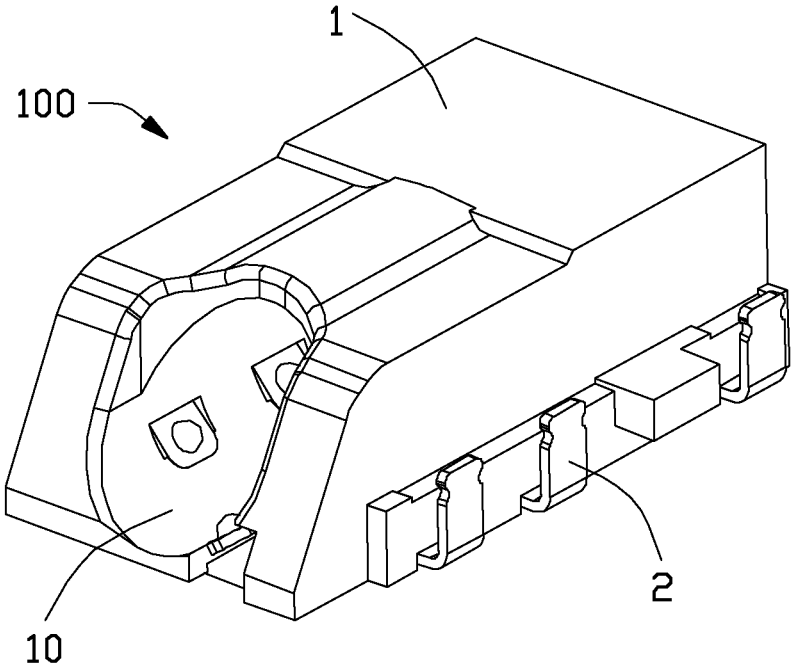
FIG. 1 is a perspective, assembled view of an audio jack connector constructed in accordance with the present invention.
Figure 2:
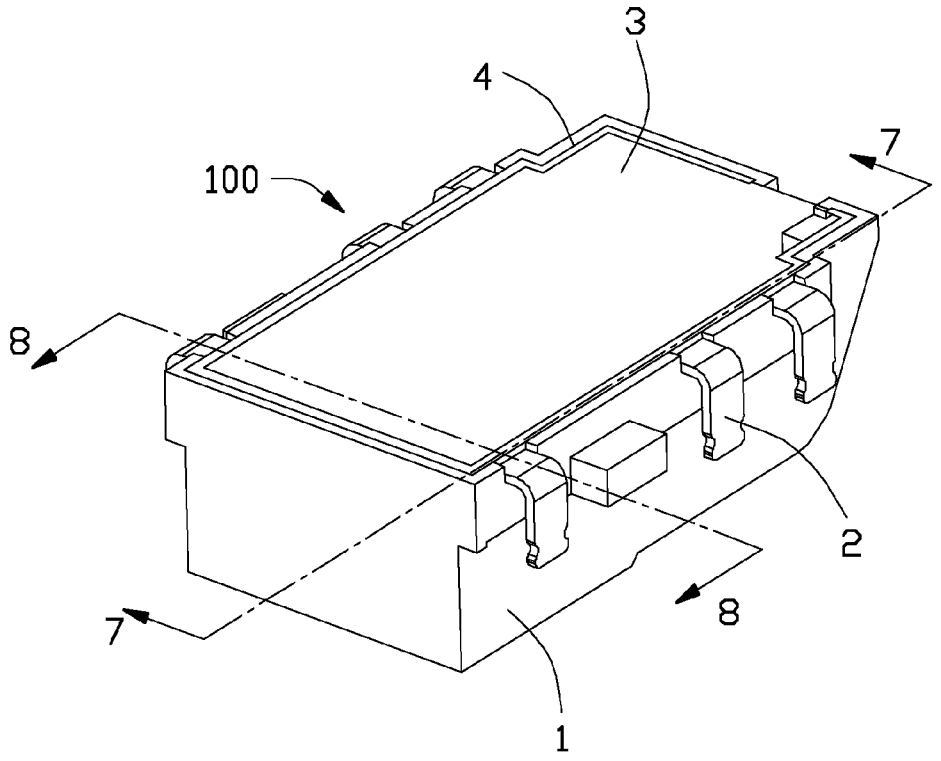
FIG. 2 is similar to FIG. 3, but taken from a different view.
Figure 3:
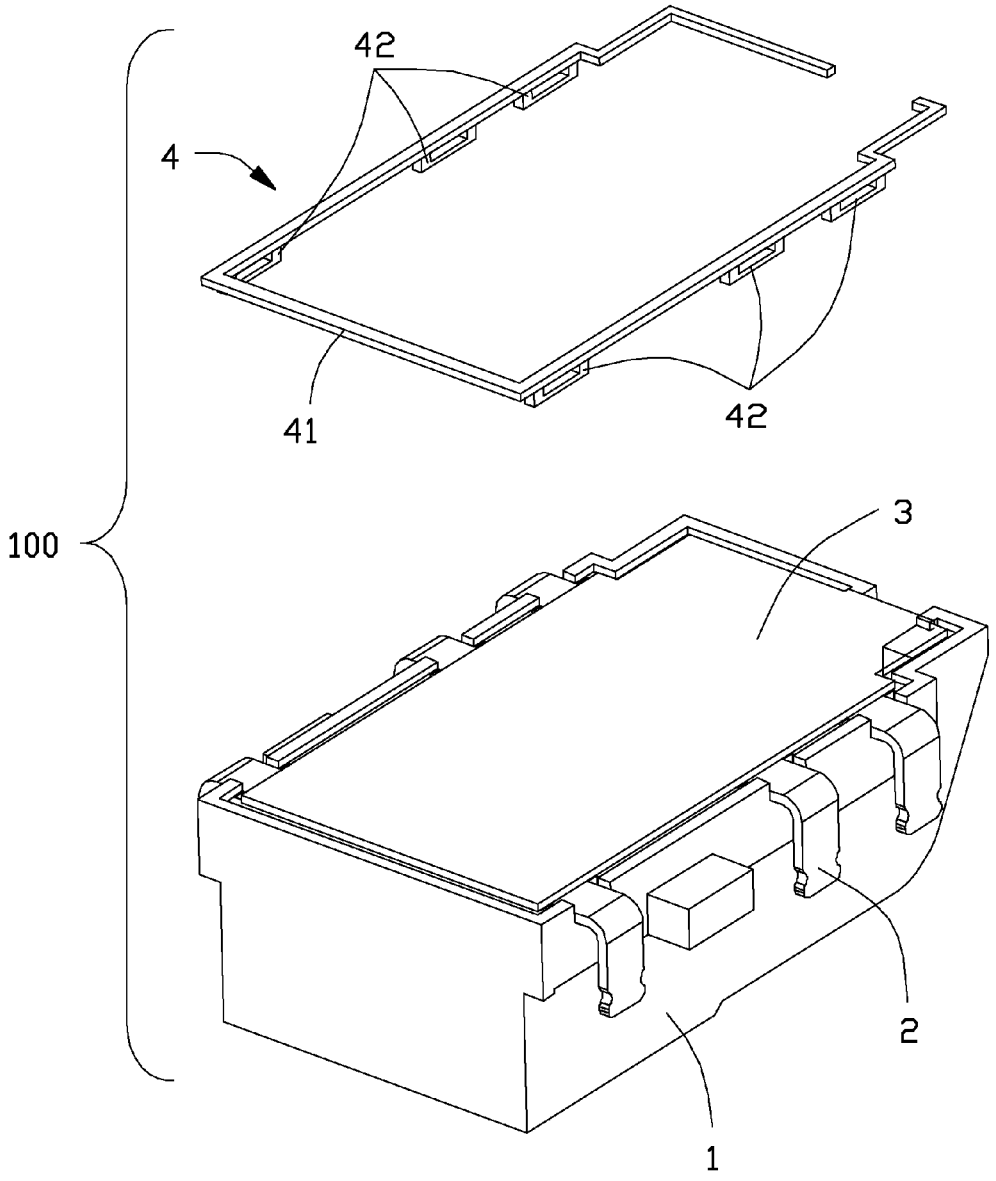
FIG. 3 is a perspective, partly exploded view of the audio jack connector when the glue frame is separated from other parts of the audio jack connector.

Reference will now be made in detail to the preferred embodiment of the present invention.

Referring to FIGS. 1-8, an audio jack connector 100 of the present invention is assembled on a printed circuit board (not shown) and is used for receiving an audio plug connector (not shown) along a mating direction. The audio jack connector 100 comprises an insulative housing 1 defining a receiving space or mating cavity 10 for the audio plug connector, a plurality of contacts 2 retained in the insulative housing 1, a glue plate 3 assembled on the insulative housing 1, and a glue frame 4 filled in an interspace between the glue or sealing plate 3 and the insulative housing 1 for waterproof purpose.

Figure 5:
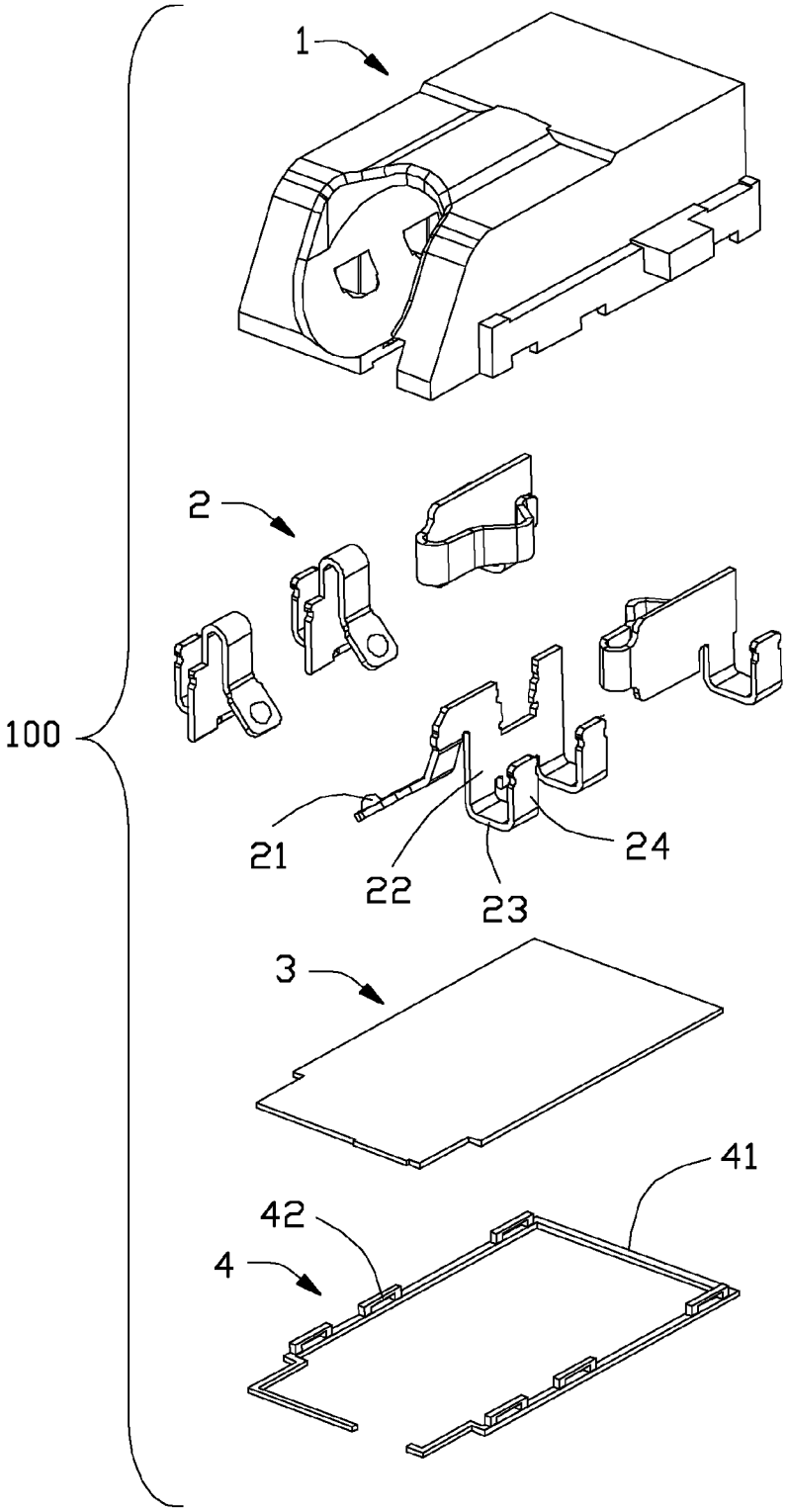
FIG. 5 is a perspective, fully exploded view of the audio jack connector.
Figure 6:
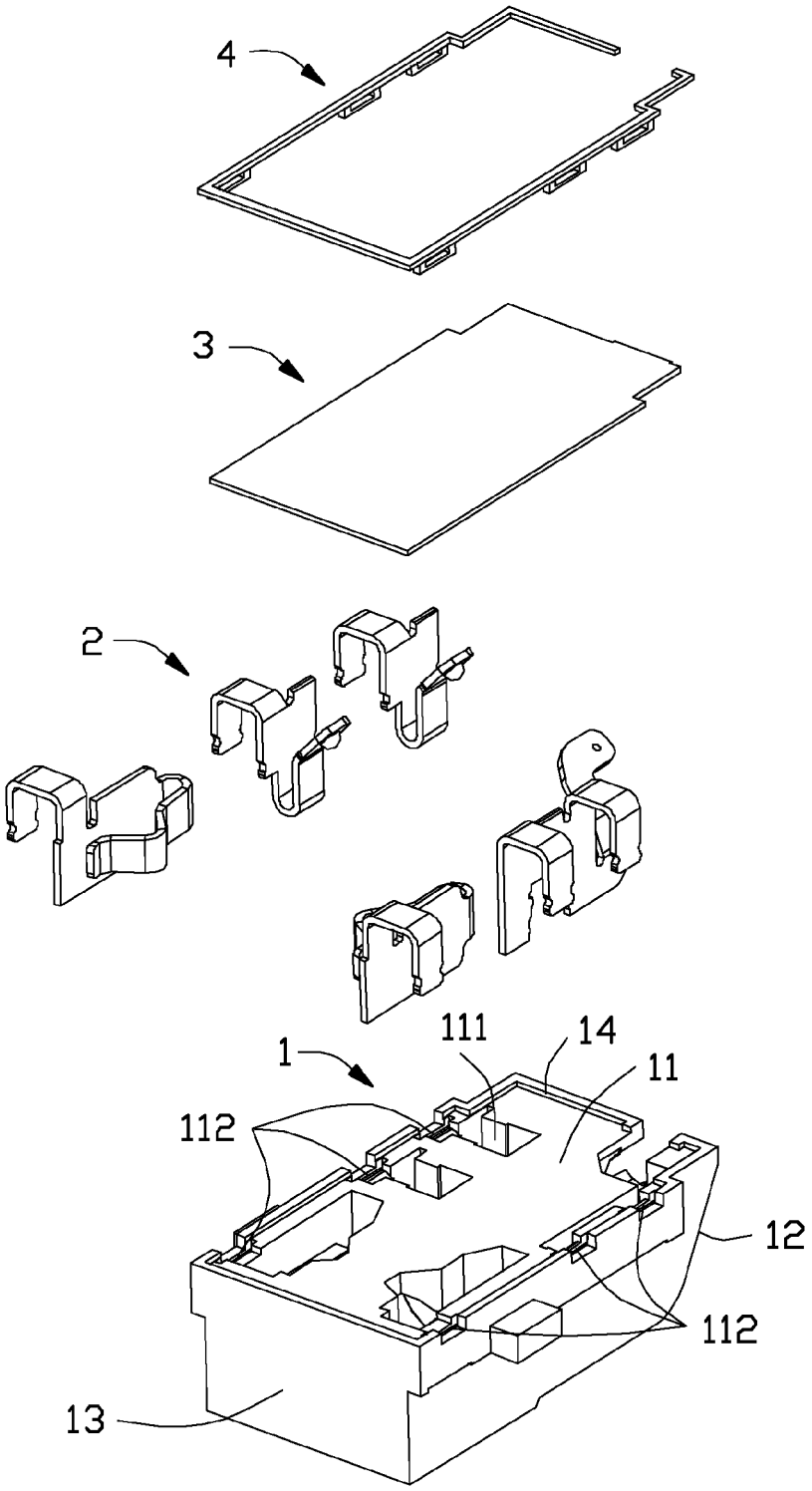
FIG. 6 is similar to FIG. 5, but taken from a different view.

Referring to FIGS. 5 and 6, the insulative housing 1 comprises a bottom face 11, a top face (not labeled) opposite to the bottom face, a mating face 12 for inserting the audio plug connector, a rear face 13 opposite to the mating face 12, and a pair of lateral faces (not labeled). Therefore, a mating direction, a vertical direction perpendicular to the mating direction, and a transverse direction perpendicular to both the mating direction and the vertical direction are defined. The insulative housing 1 has a peripheral circular rib 14 because the bottom face 11 is recessed in the middle thereof. The peripheral circular rib 14 defines a channel 140 and the glue plate 3 is assembled in the channel 140. The insulative housing 1 defines a plurality of passageways 111 respectively located at two sides of the receiving space 10. The insulative housing 1 defines a slit 112 beside each passageway 111. The glue frame 4 comprises a base portion 41 and a plurality of protrusions 42 extending vertically from the base portion 41 into the slits 112. The base portion 41 is seamlessly sandwiched between the glue plate 3 and the peripheral circular rib 14 along both the mating direction and the transverse direction.

Referring to FIGS. 4-8, the contacts 2 are assembled into the passageways 111 from the bottom face 11 of the insulative housing 1. Each contact 2 comprises a retaining portion 22 retained in the corresponding passageway 111, a contacting portion 21 extending inwardly from the retaining portion 22 into the receiving space 10, a horizontal portion or connecting arm section 23 bent outwardly from the retaining portion 22, and a securing portion 24 bent vertically and upwardly from the horizontal portion 23. The securing portions 24 are exposed out of the insulative housing 1. The retaining portion 22 and the securing portion 24 extend along the vertical direction. The horizontal portion 23 extends along the transverse direction. The slit 112 is located between the retaining portion 22 and the securing portion 24 along the transverse direction and above the horizontal portion 23 along the vertical direction after the contact 2 is assembled in the insulative housing 1.

Figure 4:
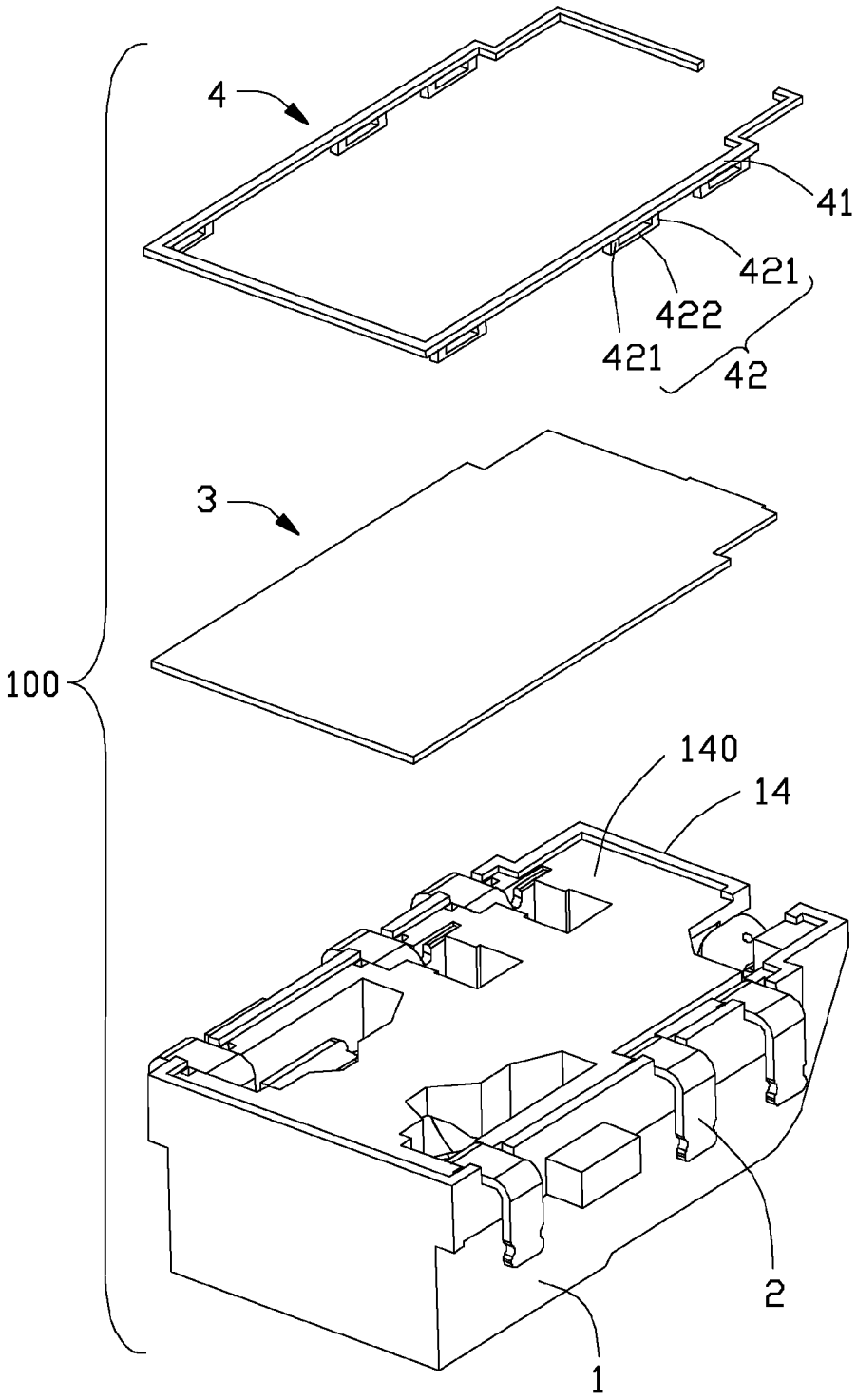
FIG. 4 is perspective, further exploded view of the audio jack connector when the glue frame and the glue plate are separated from other parts of the audio jack connector.
Figure 7:
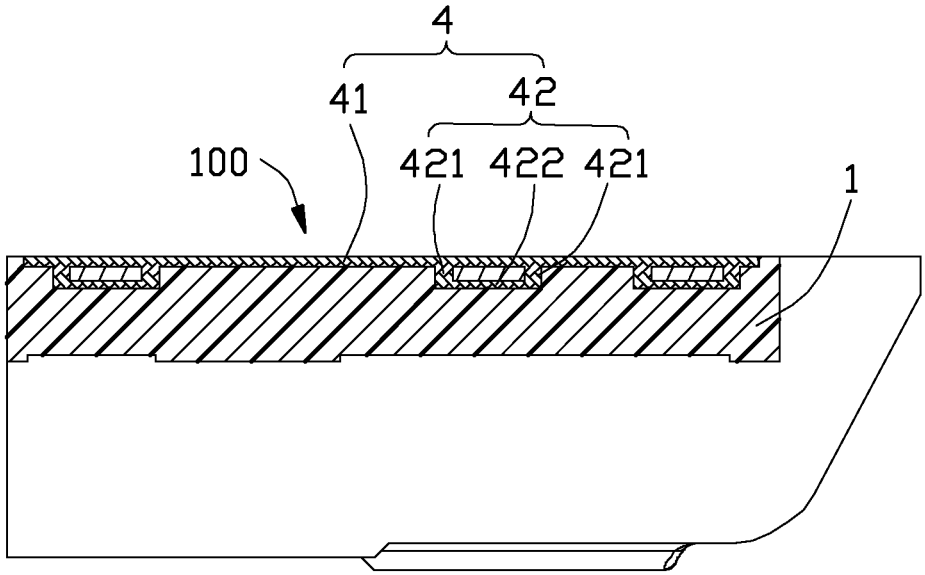
FIG. 7 is a cross-sectional view taken along line 7-7 of FIG. 2.
Figure 8:
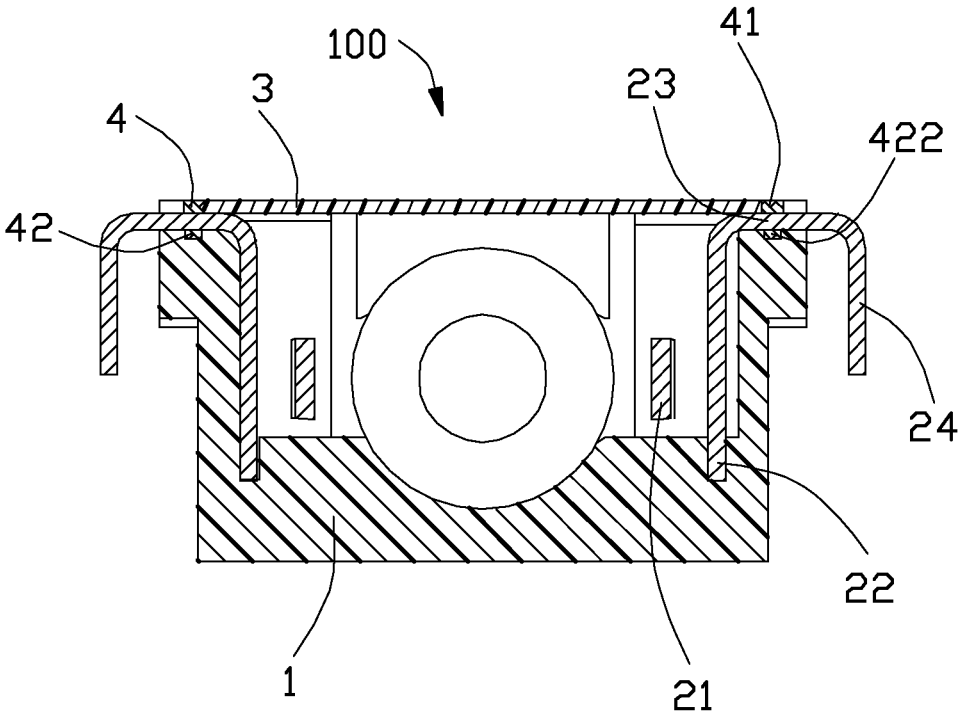
FIG. 8 is a cross-sectional view taken along line 8-8 of FIG. 2.

Referring to FIGS. 4, 7, and 8, each protrusion 42 extends to be seamlessly sandwiched between the horizontal portion 23 and the bottom face 11 of the insulative housing 1. The protrusion 42 comprises a pair of vertical beams 421 sandwiched between the horizontal portion 24 of the contact 2 and the bottom face 11 of the insulative housing 1 along the mating direction. The protrusion 42 further comprises a lengthwise beam 422 connecting between the vertical beams 421 along the mating direction. The lengthwise beam 422 is sandwiched between the horizontal portion 23 of the contact 2 and the bottom face 11 of the insulative housing 1 along the vertical direction. The lengthwise beam 422 is connected to the base portion 41 via the vertical beams 421. Therefore, the glue frame 4 seals the interspace between the glue plate 3 and the insulative housing 1 and further seals the interspace between the horizontal portions 23 of the contacts 2 and the insulative housing 1 to achieve a better waterproof effect. In this embodiment, the rib 14 forms a plurality of cutouts (not labeled) to receive the horizontal portion 23 so as to prevent the horizontal portion 23 from moving in the front-to-back direction.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An audio jack connector comprising:

an insulative housing having a plurality of passageways and a plurality of slits beside the passageways, the insulative housing having a bottom face, a top face opposite to the bottom face, a mating face, a rear face opposite to the mating face, and a pair of lateral faces to define a receiving space, a mating direction along which an audio plug connector is inserted into the receiving space, a vertical direction perpendicular to the mating direction, and a transverse direction perpendicular to both the mating direction and the vertical direction;

a plurality of contacts each contact comprising a retaining portion retained in a corresponding passageway, a contacting portion extending inwardly from the retaining portion into the receiving space, and a horizontal portion bent outwardly from the retaining portion and located at the bottom face of the insulative housing;

a glue plate assembled to the bottom face of the insulative housing; and a glue frame having a base portion seamlessly sandwiched between the glue plate and the insulative housing and a plurality of protrusions seamlessly sandwiched between the horizontal portions of contacts and the insulative housing;

wherein the protrusions are received in the slits; wherein each protrusion comprises a pair of vertical beams sandwiched between the horizontal portion of the contact and the bottom face of the insulative housing along the mating direction: wherein each protrusion comprises a lengthwise beam connecting between the vertical beams along the mating direction and sandwiched between the horizontal portion of the contact and the bottom face of the insulative housing along the vertical direction; wherein the lengthwise beam is connected to the base portion via the vertical beams.

2. The audio jack connector as claimed in claim 1, wherein the bottom face is recessed at a middle thereof to form a peripheral circular rib and the base portion is sandwiched between the glue plate and the peripheral circular rib along both the mating direction and the transverse direction.

3. The audio jack connector as claimed in claim 1, wherein each contact comprises a securing portion bent vertically and upwardly from the horizontal portion to expose out of the insulative housing.

4. The audio jack connector as claimed in claim 3, wherein both the retaining portion and the securing portion extend along the vertical direction, and the horizontal portion extends along the transverse direction.

5. The audio jack connector as claimed in claim 4, wherein the slit is located between the retaining portion and the securing portion along the transverse direction and above the horizontal portion along the vertical direction after the contact is assembled in the insulative housing.

6. An electrical connector comprising:

an insulative housing defining a mating cavity communicating with an exterior along an axial direction, a plurality of passageways extending from a bottom face of the housing along a vertical direction perpendicular to said axial direction and communicating with the mating cavity;

a plurality of contacts upwardly assembled, from the bottom face, into the corresponding passageways, respectively, each of said contacts including a resilient contacting section extending into the mating cavity, and a horizontal connecting arm section extending outwardly beyond a corresponding side face of the housing; and a glue frame surrounding a periphery of the bottom face; wherein said glue frame is further equipped unitarily with a plurality of upward protrusions each surrounding the connecting arm section of the corresponding contact.

7. The electrical connector as claimed in claim 6, wherein the housing further includes a downward peripheral rib which the glue frame outwardly abuts against.

8. The electrical connector as claimed in claim 7, further including a sealing plate on the bottom face to cover the corresponding passageways, wherein said glue frame is snugly transversely sandwiched between the sealing plate and the peripheral rib.

9. The electrical connector as claimed in claim 8, wherein the sealing plate is lower than the connecting arm sections of the contacts in the vertical direction and upwardly abuts against a bottom face of the connecting arm section of each of the contacts.

10. The electrical connector as claimed in claim 7, wherein the bottom face of the housing further forms a plurality of upward recessed recess hidden behind the corresponding side face and adjacent to said peripheral rib to receive the corresponding upward protrusions of the glue frame, respectively.

11. The electrical connector as claimed in claim 7, wherein said peripheral rib forms a plurality of cutouts to receive the connecting arm sections of the corresponding contacts, respectively, for preventing the connecting arm sections from moving along the axial direction.

12. The electrical connector as claimed in claim 7, wherein a bottom surface of the periphery rib is lower than that of the connecting arm section of the contact.

13. The electrical connector as claimed in claim 6, wherein said glue frame extends in a horizontal plane while each of said upward protrusions extends in a vertical plane perpendicular to said horizontal plane.

14. The electrical connector as claimed in claim 13, wherein the glue frame extends in a first level while each of said upward protrusions extends in a second level higher than the first level.

15. An electrical connector comprising:

an insulative housing defining a mating cavity communicating with an exterior along front-to-back direction, a plurality of passageways extending from a bottom face of the housing along a vertical direction perpendicular to said axial direction and communicating with the mating cavity;

a plurality of contacts upwardly assembled into the corresponding passageways, respectively, each of said contacts including a resilient contacting section extending into the mating cavity, and a horizontal connecting arm section extending outwardly beyond a corresponding side face of the housing;

a plurality of cutouts formed in a peripheral region of the bottom face to receive the horizontal connecting arm sections, respectively;

a plurality of slits upward recessed in the housing intimately behind the corresponding cutouts, respectively; and a plurality of glue protrusions filled within the corresponding slits, respectively, so as to seal at least an upper face and two opposite lateral faces of each of the horizontal connecting arm sections; further including a glue frame extending along the peripheral region to integrate said glue protrusions together.

16. The electrical connector as claimed in claim 15, wherein the housing forms a peripheral rib surrounds said glue frame.

17. The electrical connector as claimed in claim 15, wherein a sealing plate is attached upon a bottom face of the housing to cover the passageways, and said glue frame snugly and intimately surrounds said sealing plate.

18. The electrical connector as claimed in claim 17, wherein both said sealing plate and said glue frame are located lower than the horizontal contacting arm sections of the contacts, in the vertical direction.

19. The electrical connector as claimed in claim 15, wherein said glue frame further seals a bottom face of the connecting arm section of each of said contacts.

20. The electrical connector as claimed in claim 15, wherein said glue frame extends in a horizontal plane at a first level while each of said glue protrusions extends in a vertical plane perpendicular to said horizontal plane at a second level higher than the first level.

* * * * *